United States Patent [19]

Thorburn et al.

[11] 4,193,440

[45] Mar. 18, 1980

[54] BELT-COOLING AND GUIDING MEANS FOR THE CONTINUOUS BELT CASTING OF METAL STRIP

[75] Inventors: Herbert J. Thorburn; John A. Tracy, both of Kingston, Canada

[73] Assignee: Alcan Research and Development Limited, Montreal, Canada

[21] Appl. No.: 938,885

[22] Filed: Sep. 1, 1978

[51] Int. Cl.[2] ..... B22D 11/06

[52] U.S. Cl. ..... 164/432; 239/600

[58] Field of Search ..... 164/87, 88, 430–432, 164/443; 239/600

[56] References Cited

U.S. PATENT DOCUMENTS 4,061,177 12/1977 Sivilotti ..... 164/87

4,061,178 12/1977 Sivilotti et al. ..... 164/87

FOREIGN PATENT DOCUMENTS 1487141 5/1967 France ..... 239/600

*Primary Examiner*—Robert D. Baldwin

[57] ABSTRACT

In the continuous casting of metal in strip form between moving belts while maintaining a flowing layer of liquid coolant between the reverse surface of a belt and mutually adjacent, guiding-surface, nozzle elements that deliver such coolant, such elements are each constituted as a cooling and guiding unit having a hexagonal face and including releasable retaining elements normally holding such face (through which coolant is projected against the belt) at desired level under spring pressure against the engaged elements. The elements, respectively with the hexagonal head and with a fixed support, are disengaged by depressing the head and turning it, thus allowing removal of the device for replacement or service. As the hexagonal heads can be arranged very closely together, except for narrow, liquid-withdrawal spaces between adjacent edges, practically complete support for a coolant layer across and along the entirety of the belt, is attainable, yet with practicality of construction of the units. The engageable elements can be so arranged and shaped as to permit slight tilting of the hexagonal head units, for even greater conformity with the requirements of belt cooling.

16 Claims, 18 Drawing Figures

Fig. 1.
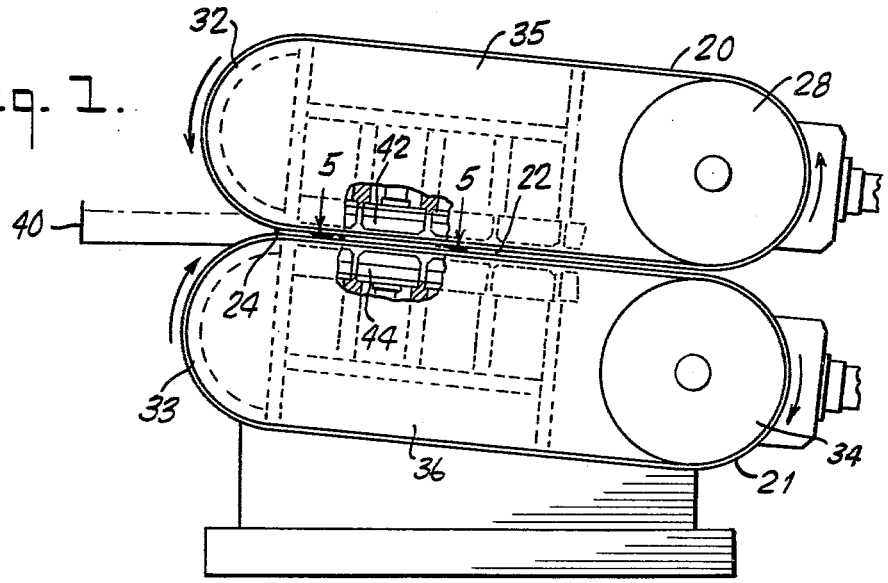
Fig. 2.
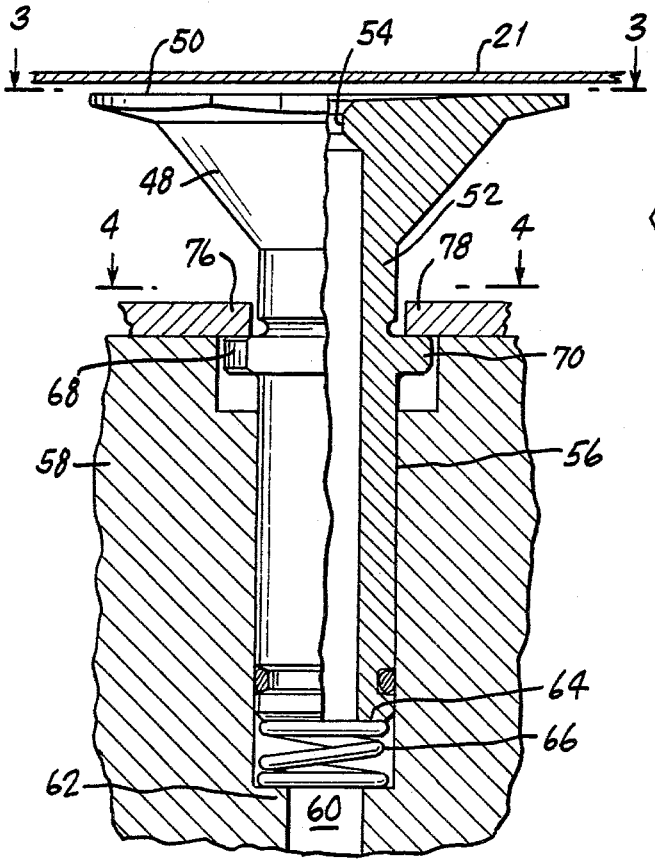
Fig. 3.
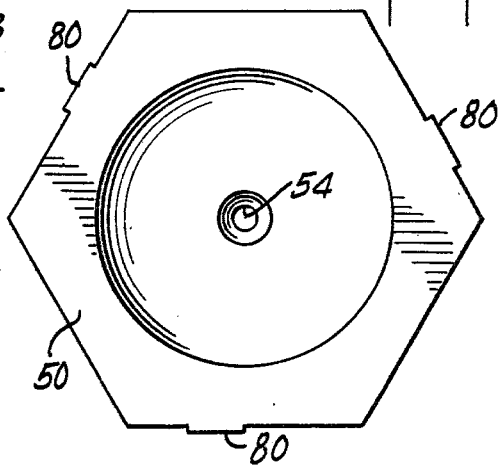
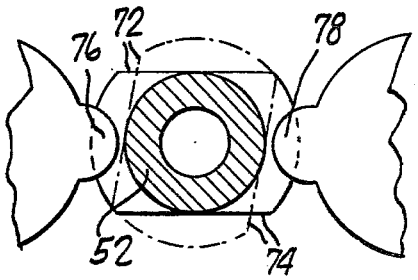
Fig. 4.

Fig. 12.
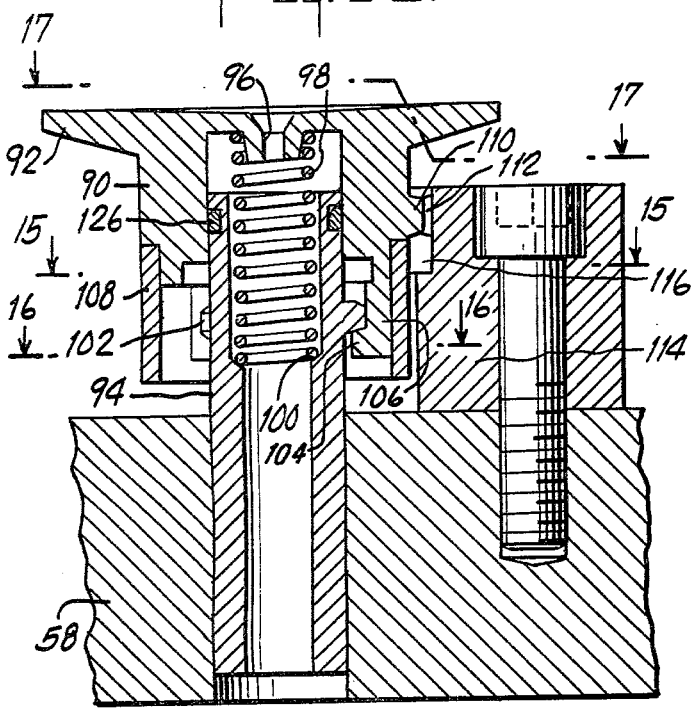
Fig. 13.
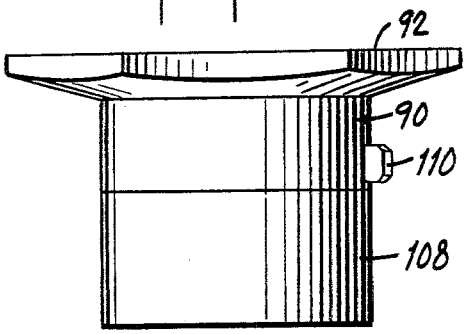
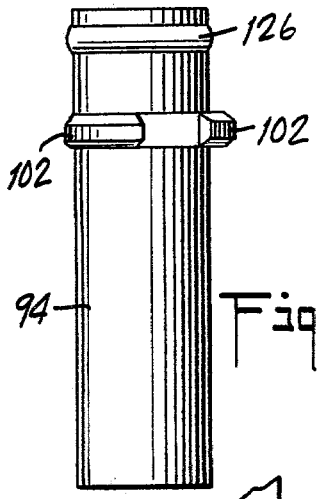
Fig. 14.
Fig. 15.
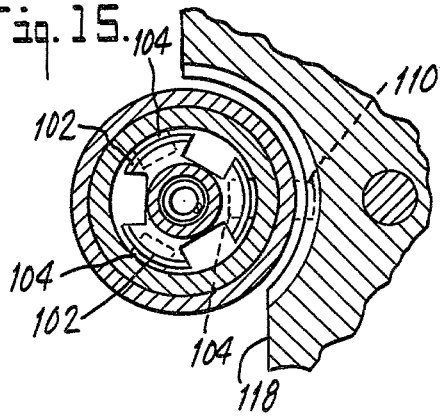
Fig. 17.
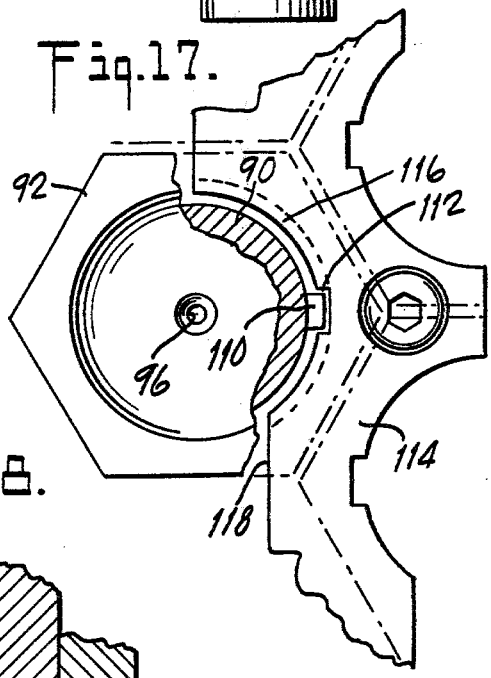
Fig. 16.
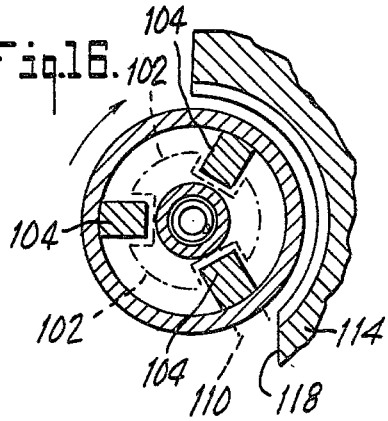
Fig. 18.
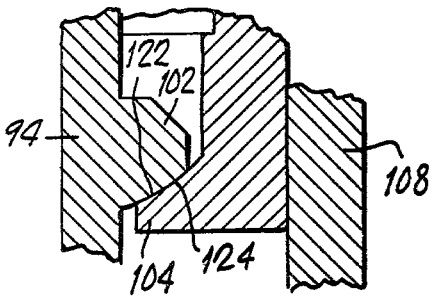

BELT-COOLING AND GUIDING MEANS FOR THE CONTINUOUS BELT CASTING OF METAL STRIP

BACKGROUND OF THE INVENTION

This invention relates to the guiding and cooling of casting belts in apparatus and procedure where metal is continuously cast on such belts, i.e. between endless belts, arranged to discharge solidified metal strip. In a notably important sense, the invention is concerned with improvements for methods and machines for casting metals, such as aluminum (including aluminum alloys) and zinc, and other metals, which melt at moderate and low temperatures, between a pair of moving surfaces conveniently constituted of flexible heat-conducting bands or belts that have conventionally been metal belts in twin-belt casters of this sort.

In a specific sense, the invention is related to belt casting apparatus and procedure such as described in U.S. Pat. Nos. 4,061,177 (Sivilotti) and 4,061,178 (Sivilotti, Steer and Stock), both issued Dec. 6, 1977. The structures and operations set forth by way of example hereinbelow and in the accompanying drawings will be shown and described as if embodied or substituted in the machine of the above patents, and such patents are therefore incorporated herein by reference, especially for the sake of any further disclosure that may be deemed desirable to facilitate further understanding of the present invention.

As will be understood, continuous metal strip casting of the sort identified above, involves the use of a pair of endless belts, usually made of flexible but stiffly resilient steel or the like, which are driven over the appropriate rollers and other path-defining means, so that they travel together along a space, usually downward-sloping or horizontal, which represents a mold region. Molten metal is introduced between the belts in the vicinity of the upstream entry end of such region, and the metal is discharged as solidified strip, from the downstream exit end of the space. In accordance with the disclosures of the above U.S. patents, means are provided for guiding and cooling the belts as they traverse their paths which define the mold space. Such means may consist of a multiplicity of guide elements or nozzles, collectively covering the entire area slightly rearwardly of the reverse surface of each belt. Liquid coolant, i.e. water, is projected through each of such nozzles, which have a substantially flat face, with the result that flowing water continuously covers the major part of the reverse or outer belt surface. Indeed, the layer of water may serve as the bearing for the belt. In the described apparatus, a liquid-bearing arrangement is also employed, where the belts are returned over a curved path to re-enter the mold space. Although it is conceivable that the improvements described below may be used in part or all of the curved guide means for such liquid bearing, the new structures are of special advantage for guiding the belts along their substantially plane paths defining the mold space, especially where some compliance of the guiding elements is needed, i.e. to move outwardly very slightly through force exerted on the belt at certain stages of the casting operation.

In the arrangements of the above patents, each casting belt is cooled and guided by a collective assembly of the above-mentioned nozzles, which have had circular faces, arranged in a close-fitting pattern at a slight distance from the reverse surface of the belt.

As will be understood, coolant liquid is projected through the central jet openings of the nozzles and flows rapidly between the nozzle face and the belt, forming the desired cooling and belt-supporting layer of the liquid. The liquid returns through the triangle-like space between adjacent nozzle faces. The effect is generally to provide a continuous layer of rapidly flowing coolant next to the belt, but although the apparatus operates usefully with the foregoing arrangement, some difficulty has been experienced with the existence of less cooling in the above-mentioned triangular areas that are employed for drainage (and that also provide access for releasing certain parts to permit removal of the nozzles) and there have correspondingly been some metallurgical defects in the cast strip, believed to result from the localized, excessive belt temperatures. In other words, these localized temperatures are found to exist and appear to have some adverse effect even though the temperature rise is relatively brief or small, since it is governed by the intermittent passage of the belt over the particular drainage areas which represent not more than about 10% of the total belt surface. In any event, although the machines of the above patents are eminently useful, some room for improvement in the above respects has been observed.

It has now been found that the requirements of belt guiding and cooling involve underlying structure for a very thin and very rapidly flowing layer of liquid coolant, with as little unsupported area as possible, i.e. with minimization of the space or spaces needed for draining the coolant liquid. Furthermore, to the extent that the belt cooling and guiding faces are separate elements, as is desired for the individual compliance described in the above patents, provision must be made for ready removal and replacement of such elements, i.e. for normal maintanence against wear or other deterioration; as will be understood, it is critical for surfaces constituted collectively by such units, for a high degree of dimensional and positional accuracy, as well as being characterized by a controlled degree of compliance where needed.

SUMMARY OF THE INVENTION

For the improvement of belt casting and to alleviate problems such as described above, the invention embraces a novel belt cooling and guiding unit for use in apparatus of the sort exemplified by the cited patents. In particular, the guiding unit comprises a guiding face having a hexagonal contour around a transverse (i.e. vertical) axis, such face being apertured, as at the center, for projecting liquid coolant under pressure against the reverse surface of a belt. Although the guiding face is substantially flat, it may have a slight depression or cavity in central regions thereof surrounding the nozzle opening, e.g. essentially as disclosed for the circular-faced nozzles of the patents.

The structure which provides the hexagonal guiding face is also arranged with supporting means, relative to a base structure that is provided for holding a multiplicity of the hexagonal-faced (or other) units in close guiding relation to the belt. In particular, this means may include resilient means, e.g. of coil springs, arranged to urge the unit toward the belt, but against the restraining element or stop; in such arrangement, the existence of excess force on the mold-space side of the belt, whether arranged by pressure difference relative to the liquid coolant or by solidified metal, may permit the belt to move the guide face rearwardly or outwardly (by action through the liquid layer) against the resilient means.

A particular feature of the present invention involves the provision of retaining elements which are mutually engageable and are associated respectively with the cooling and guiding structure (that carries the face) and immovable means constituted in or with the base-supporting structure. In particular, the hexagonal-faced means is arranged to be movable rotatably and longitudinally relative to its axis, and the retaining elements are preferably arranged, e.g. as groups of two or three spaced around such axis, so that in one angular position of the cooling face, the movable and fixed elements are mutually engaged, locking the structure in place and providing the retention of the cooling element against the resilient means (e.g. a helical coil spring), while allowing yielding or compliance as described in the patents. The arrangement is also such that when the guide-faced structure is depressed against the spring and turned about the axis, the retaining elements can be disengaged and the cooling structure removed readily.

It will be understood that the hexagonal-faced devices can be disposed in extremely close array, by the natural interfit of their sides. Such configuration could permit complete closure of the resulting composite surface; the structure or mounting of the hexagonal faces is advantageously such as to provide small grooves or spaces between the edges of adjacent faces, for discharge flow of the liquid coolant (water) that traverses the nozzle face. In some embodiments of the present invention, this spacing can be insured by small projections at the edges of the hexagonal elements, or alternatively in some arrangements, it can be achieved by special means for controlling the angular position of the hexagonal head.

As will be appreciated, the retaining elements are preferably such that they are released upon separation and upon angular movement of the nozzle head through 60° or 120° whereby the latter may be removed outwardly through the hexagonal opening constituted by the adjacent, similar heads. In one form of the invention, the structure resembles the nozzles of the cited patents in that the head is fixedly mounted upon a hollow stem which seats in a base plate or structure, resting against a coil spring. In such embodiment of the present invention, part of the supporting structure is constituted by the same portion of the removable unit with the hexagonal head. In such arrangement, the retaining elements are respectively carried on the stem and on the base plate or structure having recesses in which such stems are seated.

In another modification of the invention, the hollow stem is constituted as a separate device from the head element which carries the nozzle opening and the hexagonal guide faces. In such arrangment, the resilient means is constituted between the head assembly and the stem, with retaining elements correspondingly associated with such assembly and stem. In consequence, if the stem is tightly secured in the base plate, similar depression and rotation of the head assembly against the spring and relative to the base and stem, serves to disengage the hexagonal head for removal.

In arrangements of the last-mentioned type, releasably engageable means can also be provided for locking the head structure against rotation until such structure is depressed to overcome the force of the spring. Such angular restraint of the head is found sufficient to position the head relative to adjacent hexagonal faces, i.e. for the desired narrow groove or space along each pair of adjacent edges, without requiring spacing projections or the like. Another feature of the present invention, particularly adaptable to the two-part unit just described, is that the retaining elements respectively on the removable unit and the secured stem structure may have abutting faces constituting a spherical joint with a center such as at a suitable place on the axis of the unit. This arrangement permits the head unit, while fully retained against vertical displacement under the pressure of the spring, to rock slightly about the center of the spherical surfaces. In other words, the guiding face, over which the coolant flows, can move a small amount angularly in any direction. Such motion is believed to permit even better accommodation of the guiding surface to requirements of belt guiding and cooling, with respect to unanticipated irregularities or solidification difficulties as the belts travel.

BRIEF DESCRIPTION OF THE DRAWINGS

FIG. 1 is a general side view, chiefly in elevation and relatively simplified or schematic manner without associated drive or supporting means, of a twin-belt casting apparatus in which the present invention may be utilized.

FIG. 2 is an enlarged, vertical view including a hexagonal-faced head and stem unit and associated means of the present invention, the unit being shown partly in vertical elevation and partly in vertical section as apparent, with associated supporting structure in section and a fragment of a related steel belt.

FIG. 3 is a plan view of the device of FIG. 2, as on lines 3—3.

FIG. 4 is a fragmentary, horizontal section on lines 4—4 of FIG. 2.

FIG. 12 is a vertical, sectional view of another embodiment of the invention showing the head unit retained by cooperating means with a fixedly held stem structure.

FIG. 13 is an elevation of the movable unit of FIG. 12.

FIG. 14 is an elevation of the permanent stem structure of FIG. 12.

FIG. 15 is a fragmentary, horizontal section on lines 15—15 of FIG. 12.

FIG. 16 is a fragmentary, horizontal section as if on lines 16—16 of FIG. 12, but with the head unit moved, i.e. rotated, to a position for release.

FIG. 17 is essentially a plan view on lines 17—17 of FIG. 12.

FIG. 18 is a greatly enlarged, fragmentary, vertical section of the relatively fixed and movable retaining elements as shown in FIG. 12.

DETAILED DESCRIPTION

Figure 5:
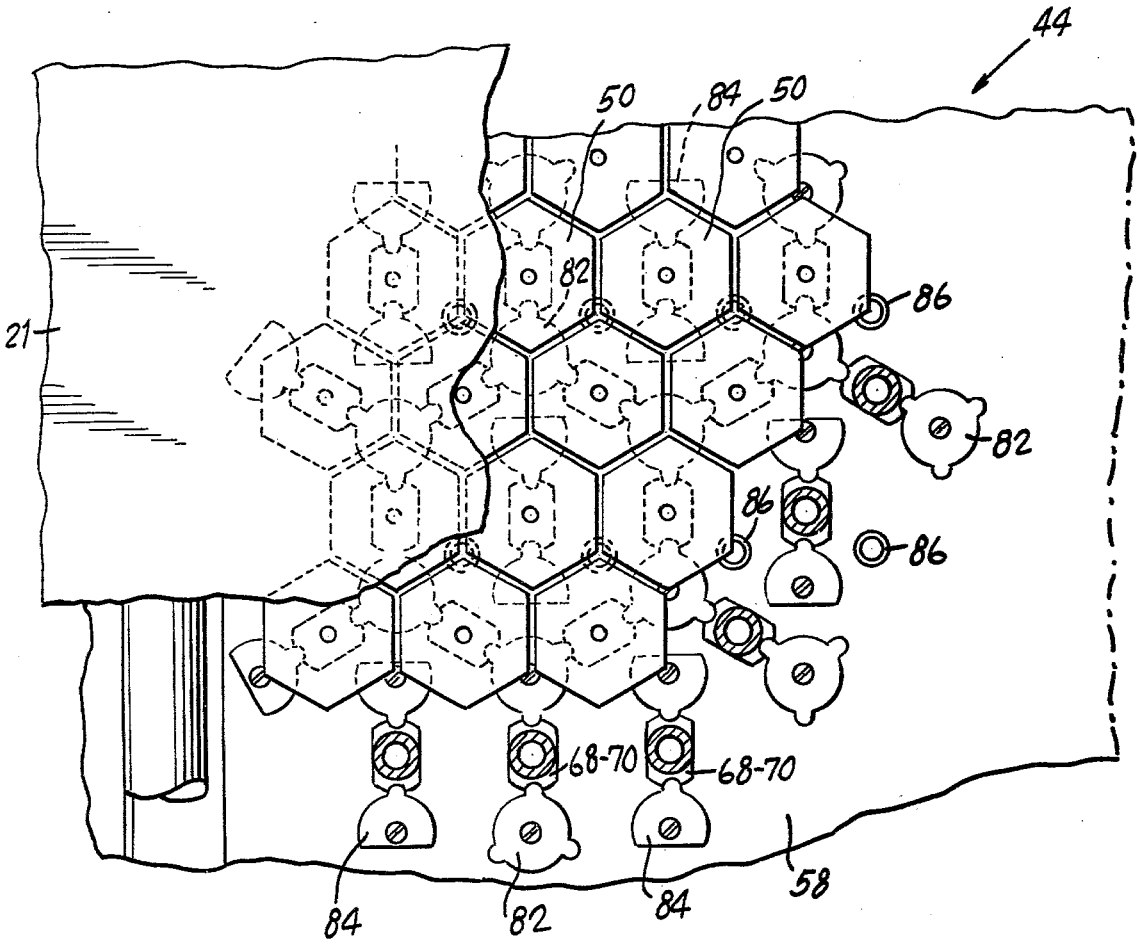
FIG. 5 is a substantially horizontal view seen as if on lines 5—5 of FIG. 1, showing an arrangement of devices such as depicted in FIGS. 2 to 4, arrayed for constituting a belt-guiding surface.

Referring to the drawings, the example of a basic belt casting machine as contemplated herein embraces a pair of resiliently flexible, heat conducting belts, being upper and lower endless belts 20 and 21 in FIG. 1, which are arranged to travel in oval or otherwise looped paths, so that in traversing a region where they are close together, moving with a small degree of downward slope they define a casting space 22, extending from a liquid metal entrance end 24 to a solidified strip discharge exit end 26. As will be seen, the belts 20 and 21 are respectively carried around and by, large driving rollers 28 and 34, to return toward the entrance end 24, after passing around curved, liquid-layer bearing structures, respectively shown at 32 and 33. As will be understood, the supporting carriage structures 35 and 36 for the respective belts 20 and 21 are mounted on a certain bearing structure, while the drive rolls 28 and 34 are appropriately carried and connected for suitable motor drive, all by means of known character, not here shown.

Molten metal can be fed to the mold space 22 in any suitable fashion, as from a continuously supplied trough or launder 40. As the liquid metal in the space 22 moves along with the belts, the latter are continuously cooled and effectuate solidification of the metal, inward from its contact with the belts, so that solid, cast strip is discharged at 26. Convenient means for cooling the belts may be constituted of a large multiplicity of substantially flat-faced nozzle structures, arranged as described above, so as to cover the area facing the reverse surface of each belt, with a slight spacing from the belt, so that jet streams of liquid coolant projected perpendicular against the belt through the nozzle faces flow outwardly over the face, returning to the appropriate discharge means. Thus, the liquid coolant, which is ordinarily water, is maintained in a fast flowing layer between the belt and the assembly of guide surfaces. The nozzle units are conveniently mounted or carried by base structures, which may include heavy steel plates having passages for receiving the stems of the units, with associated means supplying water under pressure at one side of the base plate, to enter the passages and the stems, with appropriate means for withdrawing water, as to suitable pipes, from the passage side of such plate, i.e. directly beneath the nozzle faces.

Thus, in FIG. 1, one assembly of such base plate or structure with a multiplicity of nozzle elements (not here shown) is indicated at 42, for the reverse face of the upper belt 20, while a like assembly 44 is indicated for the reverse face of the lower belt 21. As will be understood from the cited patents, a further convenience of arrangement is involved in providing several such cooling pads, e.g. identical with the pads 42 and 44, successively disposed along the path of each belt, whereby the entire areas of the belts as they pass the mold space 22, are covered by the guiding and cooling nozzle heads constituted in the defined cooling pads. For convenience herein, with respect to illustration and description of the novel guiding and cooling structures of this invention, such parts will simply be shown as if embodied in a lower cooling pad or the like at 44, but it will be understood that identical means should be provided for the upper cooling pad 42, and advantageously identical means are contemplated to be provided for all of the cooling pads, both above and below and thus with respect to both belts, throughout the entire length of the mold space in the illustrated machine.

In reference to FIGS. 2 to 4 inclusive, the illustrated embodiment of the present invention, i.e. serving as one example thereof, includes a head structure 48 having a hexagonal face 50 and an integral stem 52, which is a hollow tube extending angularly to open through a narrow nozzle 54, centered in the hexagonal face 50. The latter face can be described as substantially flat, although it is usually desired to have a slightly depressed configuration, e.g. tapered very slightly toward the central opening 54, e.g. in the same manner as described with respect to the circular-faced nozzles of the cited patents.

The stem 52, which has a diameter greatly less than the hexagonal face 50, is arranged to be received, in vertically slidable and rotatable fashion in a passage or recess 56 of the base plate or structure 58, which provides, at the bottom of the recess 56, a reduced opening 60 bounded by a circular flange 62. Between the flange 62 and the lower end 64 of the guide unit stem, a compressed coil spring 66 serves to urge the unit upwardly, but to permit some downward, forcible movement of the unit, sliding within the recess 56, against such spring.

The stem carries projecting flange structure constituting a pair of curved retaining elements 68 and 70, which are disposed opposite each other by 180° relative to the central axis of the unit and are thus projected in opposite directions, being bounded, for example, by a pair of straight sides 72, 74 having the same width as the shank of the stem 52.

To co-act with the elements 68, 70, the heavy base plate 58 may carry a pair of hold-down or keeper members 76, 78 having a suitable shape (e.g. as shown), so that when the retaining elements 68, 70 are in the full-line position of FIGS. 2 and 4, the latter are engaged beneath the keeper members 76, 78, held there by the force of the spring 66.

The position just described is the normal, operative situation of the hexagonal guiding and nozzle unit, when it is spaced close to the belt 21, whereby water received from below the plate 58, under high pressure, is forced through the nozzle opening 54, striking the belt and spreading out in all directions over the face 50 to discharge over the edges of the face into the region above the plate 58, from which liquid withdrawal means conducts such water, as indicated in the cited patents (not here shown). At times when it is desired to remove the guiding unit (and like units), as for replacement, repair or other servicing of the machine, when the latter has been taken out of use and the belts 20, 21 have been removed, the hexagonal-faced assembly may be pushed down against the spring 66 and rotated, i.e. turned counterclockwise as seen in FIG. 4. With such rotation through an angle of 60°, the elements 68, 70 are disengaged from beneath the elements 76, 78 and the assembly moves upwards, e.g. under the influence of a spring, with the retaining elements passing each other. Such angular movement is presumably effected through exactly 60°, so that the hexagonal head has the same geometrical relationship and thus able to pass through the opening bounded by adjoining such heads or faces. For maintenance of the desired narrow groove or space between the edges of the adjacent hexagonal face, each such face may carry a slight projection 80, which can abut the edge of the next hexagon. For proper function of the twist-removal operation, these projections 80 can be fashioned near to one end of each hexagon edge (as shown) rather than in the center; in such way, there is no interference when the head has been rotated 60°.

Figure 8:
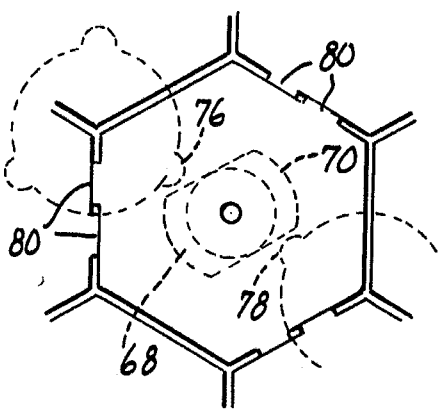
FIGS. 6, 7 and 8 are fragmentary, plan views of one of the hexagonal-faced units of FIGS. 2 to 4, showing its orientation for both normal, retained positions and as turned for removal.
Figure 7:
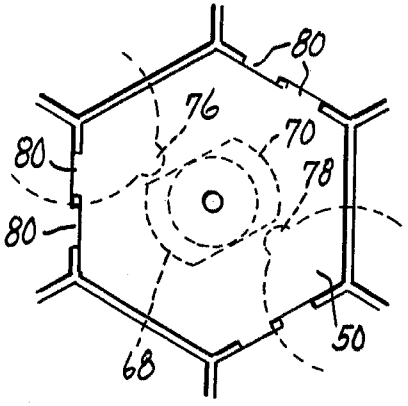
Figure 6:
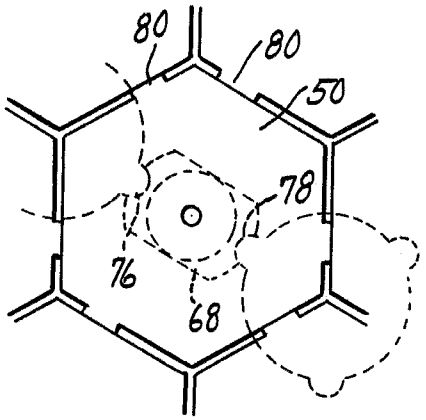
Figure 11:
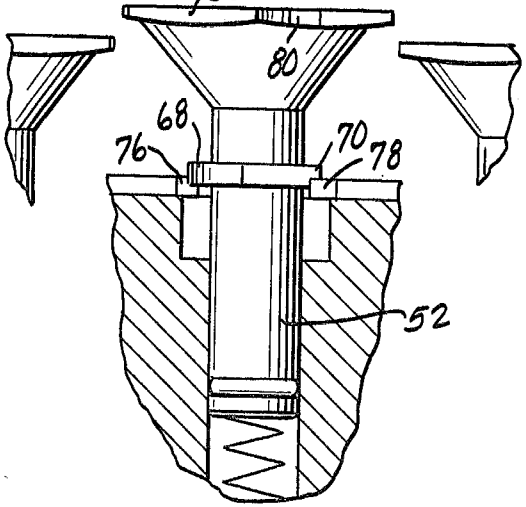
FIGS. 9, 10 and 11 are vertical, sectional views of the structures of FIGS. 6, 7 and 8 respectively, with the head and stem unit in successive positions during operation to remove the stem.
Figure 10:
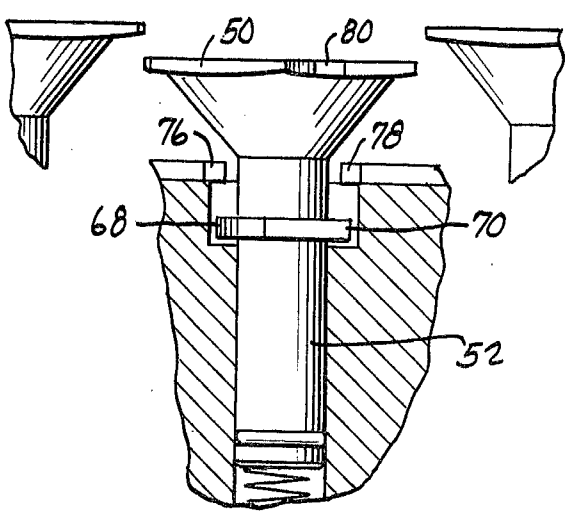
Figure 9:
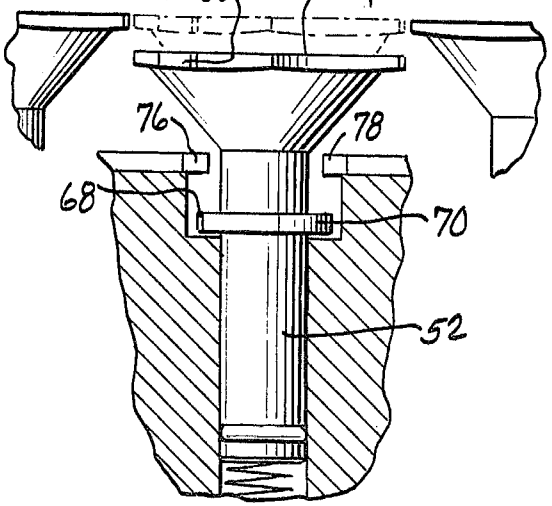

The operation of removing the hexagonal head is especially illustrated in FIGS. 6 to 11 inclusive. Thus, in FIGS. 6 and 9, the unit has simply been pushed down from its normal, locked position (indicated by dot-and-dash lines), with the movable elements 68, 70 directly beneath the fixed elements 76, 78. In FIGS. 7 and 10, the unit, while still held in the downward position, has been turned angularly counterclockwise, through 60°, so that the elements 68, 70 are clear of the fixed elements 76, 78. In FIGS. 8 and 11, pressure on the unit has been released, so that it has been pushed up by the force of the spring 66, carrying the retaining elements 68, 70 freely past the fixed elements 76, 78 and disposing the hexagonal face 50 in position for ready grasp and removal by service personnel. As will be understood, replacement of a hexagonal-headed unit involves exactly the reverse operations, i.e. depressing the unit with the retaining elements clear, and then twisting the unit while depressing the spring, so that it can rise as from a position of FIGS. 6 and 9 into locked, normal, operating condition. FIGS. 6, 7 and 8 also show the positions of the spacing projections 80 on the central hexagonal-faced head, and also on the adjacent such heads. The function of the projections in maintaining the spacing are shown in FIG. 6, and the manner in which the projections are clear of each other during the removing or replacing operation, is apparent from FIGS. 7 and 8.

FIG. 5 is a partial plan view showing a multiplicity of the hexagonal-headed nozzles 50 removably mounted in the base plate 58. It will be apparent that with this configuration of guide faces, the space to be cooled beneath the belt 21 is practically completely covered except for the small grooves between the hexagonal edges. The spacing projections 80 are omitted from this view for clarity. As will be apparent, the hold-down or fixed retaining elements may, for at least certain groups of nozzle units, be constituted as combined elements 82 secured to the face of the plate 58. For some of the hexagonal units, separate, single retainers 84 are necessary. FIG. 5 also shows pipes 86, of which any required number may be provided, that traverse the heavy plate 58 and indeed the liquid supply manifold space beneath it, to carry return water from the space immediately under the nozzle plates to an appropriate suction discharge. As will be seen, the several retaining element structures 82, 84 can co-act with the movable retainers 68–70 of the nozzle units, in the manner previously described.

Another embodiment of the cooling and guiding devices is shown in FIGS. 12 to 18 inclusive, where the hexagonal-head unit 90, having a similar hexagonal face 92, is a separate element from the hollow stem 94 which is permanently and precisely seated, against any movement, in a recess of the base plate 58. The nozzle head 90 has an interior recess, which opens through the nozzle aperture 96 to the center of the face 92 and also seats around the aperture 96, the upper end of coil spring 98, which extends axially inside the hollow stem, i.e. to the bottom 100, of an enlarged upper portion of the central passage of the stem. As will now be seen, the head structure 90 is slidably fitted over the exterior of the stem 94, and with the latter, encloses the spring 98, which can be compressed and which thus can tend to urge the head 90 upwardly relative to the stem 94.

The stem 94 also carries three outwardly projecting flanges or retaining elements 102 peripherally spaced about the stem and arranged to co-act with like studs or fingers 104 at the lower ends of legs 106 depending from the head structure 90. As will be seen, the elements 102 project outwardly into the space that surrounds the stem 94, while the elements 104 project inwardly into such space from the legs 106 which depend from the body 90 and carry these lugs.

The arrangement is thus such that in one position, shown in FIGS. 12 and 15, the lugs 102 override the lugs 104 and thus hold the hexagonal head in place against the upward force of the spring 98. The head 90 is pushed down and turned, for example clockwise by 60°. As shown in FIG. 16, the elements 104 are no longer aligned beneath the elements 102, whereby the head assembly may be allowed to move up (by the spring) and be removed. As will be understood, upon movement of 60°, the hexagonal face is identically oriented relative to adjacent hexagonal faces so as to permit such upward removal in the same manner as previously described.

The head 90 may carry, as properly secured thereto by force fit, a depending skirt 108, surrounding the lower parts so as to afford a guard for protection against inadvertent damage to the structures there enclosed—e.g. by unwanted accidental overload on the units.

The body of the head 90 also carries a projecting lug or key 110 at one side of its upper periphery, shaped to fit within a notch 112 in a block or plate 114 secured to the upper surface of the base plate 58. Extending from the notch 112, the upper plate 114 carries a horizontal groove 116 that curves around in conformity with the head body 90 and its skirt 108, such groove being deeper than the projection of the lug 110 and such groove also communicating vertically with the recess 112. As will now be seen, when the head 90 is inserted into place and the retainer elements 102, 104 have been turned so that they come into retaining engagement, the lug 110 will rise into the notch 112 and there be held against any angular displacement. For removal of the hexagonal head, the latter is depressed in the manner described above, for release and turning to the mutual disengagement by turning of the elements 102, 104. This downward pressing action displaces the lug 110 into the groove 116 so that when the head 90 is turned, the lug moves along the groove and finally is released from the edge 118 of the plate 114, e.g. as shown in FIG. 16. Thus, the entire head is removable by the relatively simple manipulation described, and is as easily replaced, by reverse operation, when desired. As will be seen from FIG. 17, the plate 114 may be shaped to accommodate similar function with respect to a number of adjoining hexagonal-head units, not shown.

If desired, the lower face 122 of each flange element 102 and the upper face 124 of each inwardly-projecting lug 104 may have a spherical configuration. That is to say, these faces may constitute mating portions of spherical surface, having a center on the vertical axis of the hexagonal-head unit, very preferably at a locality at the natural center of rocking or tilting rotation of the head unit about the stem. With these mutually mating, spherical configurations (or shapes having about the same function) of the retaining elements (FIG. 18), the head unit 90 is free to rock or tilt, to at least a slight extent, in any direction relative to the spherical center. Such freedom of motion is of special advantage in guiding and supporting the moving belt of the caster, as to accommodate transient, local distortions or unusual forces, while maintaining maximum cooling and supporting action for the belt. The hexagonal-head unit normally maintains (because of the spring 98) its position of having its face (except for the slight central depression) congruent with the plane of the belt-supporting pad 42 or 44. However, these local dislocations are enabled to take place by the freedom of rocking movement, in a limited sense, for best belt conformity and cooling operation.

As will be understood, the number of retaining elements spaced around the fixed and movable parts of the hexagonal-head unit can vary, for example, being one, two or three of each type of unit, as may be required for superiority or ease of manufacture. Thus, the devices of FIGS. 2 to 11 can employ sets of three projecting flanges, rather than two as shown. Alternatively, the structure of FIGS. 12 to 18 may be fashioned with two projections 102, diametrically opposed, as distinguished from the three sets of projections shown.

As will now be seen, the devices of the present invention afford a greatly improved mode of guiding and cooling the casting belts, so as to maintain a rapidly flowing layer of liquid, over practically the entire reverse surface of each belt, with only very narrow groove areas, between hexagonal edges, where liquid returns. As in the situation of the structures of FIGS. 12 to 18, retention of the hexagonal head by the lug 110 in the notch 112 can accurately position the head so that no separating projections are necessary to maintain the desired small spacing of the head from adjacent hexagonal edges on the accompanying heads, e.g. as shown in FIG. 17.

Although the provision of truly spherical mating surfaces 122, 124 for the elements 102, 104 in FIG. 18 has been described, it has been found that other, more practical configurations for the engaged faces of the stem-carried elements and the head-carried elements can be satisfactory to achieve an approximately spherical joint. Thus, the surface 122 of each element 102 can have a curved corner or small-radius curve (e.g. as a toroidal shape around the stem 94) which has a circular line of contact with the surface 124 of the elements 104; the surfaces 124 can then be conical about the axis of the assembly, providing a center of rotation or tilting (relative to engaged surfaces 124) which lies at a suitable point on such axis. Although other points on that axis are possibly suitable for such center of the spherical joint action, i.e. in the zone between the face 92 and the elements 102, as at the plane of such face 92, superior results appear attainable with such center in the plane of the sealing ring 126 (e.g. a stiffly compressible O-ring or the like) around the stem, holding the head unit. In such case, desired, small tilting or rocking of the head is obtainable without losing accuracy of liquid-bearing-supporting position of the hexagonal face and without loss of the water (liquid coolant) layer at any locality across such face. Having regard to the forces or pressures acting on these heads in their intended use (see the cited patents), it is found that the liquid layer is capable of transmitting sufficient moment from the belt to produce a desired accommodative tilt of the hexagonal head.

As will be understood, all of the cooling and guiding pads (as 42, 44) along upper and lower belts 20, 21, may be composed of hexagonal-faced units of the nature herein shown, e.g. one or the other of the two embodiments, with great utility in maintaining the desired, rapidly flowing, water cooling layer over essentially the entire rear surface of each belt.

We claim:

1. A belt cooling and guiding unit for continuous casting apparatus where liquid metal is cast between a pair of movable heat-conducting belts to discharge as solidified strip, said apparatus including a base structure having passages for delivering liquid coolant to a multiplicity of such units which collectively face the reverse surface of at least one belt to provide a layer of liquid coolant at said surface, comprising means providing a substantially flat guiding face having a hexagonal contour around a transverse axis and apertured for projecting liquid coolant against said reverse belt surface, means for supporting said first-mentioned means in registration with one of said base passages for coolant supply, said supporting means including means resiliently urging said first-mentioned means toward said belt surface, and mutually engageable retaining elements respectively associated with said first-mentioned means and arranged to be held with the base structure, said first-mentioned means being rotatably and longitudinally movable relative to said axis and said elements being constructed and arranged so that from a position of engagement to hold the first-mentioned means against axial displacement by the resilient means, said elements can be disengaged by depressing the first-mentioned means against said resilient means and rotating it whereby it can be removed axially, said hexagonal face being shaped so that it and like hexagonal faces can completely cover a belt-facing area with narrow openings between adjacent hexagonal edges for return of liquid coolant projected against the belt surface through the hexagonal faces, said retaining elements being mutually shaped so that in their engaged, holding position the aforesaid unit is held with its hexagonal face edges in closely aligned spacing next to the said adjacent hexagonal edges of said like hexagonal unit faces, and so that when the elements are disengaged by depressing and rotating the first-mentioned means, the hexagonal face edges of the aforesaid unit are in another position for like closely aligned spacing with the adjacent hexagonal edges of the adjacent hexagonal unit faces, to permit axial removal of the aforesaid unit through the hexagonally defined opening between the hexagonal faces of the adjacent units.

2. A cooling and guiding unit as defined in claim 1 in which said supporting means includes a hollow stem formed and movable with the first-mentioned means and insertable in said one of the base passages, said resilient means being arranged to act between the base structure and said stem, said retaining elements including at least a first element projecting from the stem and movable therewith, and at least a second element projecting from the base structure to hold the stem-carried element, when the latter is in one angular position, from being moved axially by the resilient means.

3. A cooling and guiding unit as defined in claim 2 in which the retaining elements include a plurality of first elements projecting radially outward from the stem and a plurality of second elements projecting radially inward toward the stem from the base structure, said first and second elements being mutually related and spaced around the axis of the stem so that in one angular position of the stem relative to its axis, the first elements engage the second elements and so that the first elements can be removed from such engagement by depressing the stem and rotating it through an angle that brings the hexagonal contour of the guiding face to a hexagonally congruent position.

4. A cooling and guiding unit as defined in claim 1 in which said supporting means comprises a hollow stem fixedly carried with said base structure, and said first-mentioned means is a head unit rotatably and removably mounted on said stem, said resilient means being disposed to act between the stem and the head unit, and said retaining elements being respectively carried by said head unit and stem and arranged for mutual engagement at one angular position of the head unit and for disengagement at another angular position of said unit.

5. A cooling and guiding unit as defined in claim 4, including mutually engageable structures respectively carried by the head unit and fixedly carried by the base structure, for holding the head unit against rotation from a predetermined angular position, said structures being disengaged when the head unit is depressed against the resilient means and turned, for removal of the head unit.

6. A cooling and guiding unit as defined in claim 4, in which said head unit includes a body portion seated over the stem and having depending legs spaced around the stem, each of which carries an inwardly extending retaining element, said stem carrying a plurality of outwardly extending retaining elements spaced identically to the inwardly extending elements, said leg-carried elements being held against the other elements, in a direction toward the hexagonal face when the elements are engaged.

7. A cooling and guiding unit as defined in claim 6, in which the stem-carried elements and leg-carried elements have engageable faces which are mutually shaped to constitute an approximately spherical joint about the center on the axis of the hexagonal surface, said center being at a point spaced between said surface and the engaged elements, whereby the head unit is capable of being tilted slightly relative to said axis.

8. A cooling and guiding unit as defined in claim 7, in which the stem carries a peripheral, compressible, sealing member engaging the body portion internally when said portion is seated over the stem, the aforesaid element faces being constructed and arranged so that the aforesaid spherical joint center lies approximately on a plane through said sealing member.

9. A cooling and guiding unit as defined in claim 4, in which the retaining elements are mutually shaped to constitute, when engaged, an approximately spherical joint between the head unit and the stem, to permit the head to be tilted slightly relative to a point on the axis of the hexagonal surface which lies in a zone bounded by said surface and the retaining elements.

10. A belt cooling and guiding unit for continuous casting apparatus where liquid metal is cast in contact with at least one movable heat-conducting belt to discharge as solidified strip, said apparatus including a base structure arranged to deliver liquid coolant to a mutliplicity of such units which collectively face a reverse surface area of said belt to provide a layer of liquid coolant at said surface, comprising:

a. means providing a substantially flat guiding face having a hexagonal contour around a transverse axis and apertured for projecting liquid coolant against said reverse belt surface, b. means for supporting said first-mentioned means in location to receive coolant supply through the base structure, said supporting means including resilient means urging the first-mentioned means axially toward said belt, and c. mutually engageable retaining elements respectively associated with the first-mentioned means and arranged to be held with the base structure, d. said elements having a position of engagement to hold the first-mentioned means against displacement by the resilient means toward the belt, and said elements being constructed and arranged so that from said position of engagement said elements can be disengaged by depressing and rotating said first-mentioned means, to permit axial removal of said first-mentioned means, e. said hexagonal contour of said face being shaped so that a multiplicity of such units may be disposed with their faces in a common surface and their hexagonal edges in closely aligned spacing next to each other, and f. said retaining elements being mutually shaped so that in their engaged, holding position the aforesaid unit is held with its hexagonal face edges in said closely aligned spacing with the hexagonal face edges of adjacent units, and so that when the elements are disengaged by depressing and rotating said first-mentioned means, the hexagonal face edges of the aforesaid unit are in another position for like closely aligned spacing with the hexagonal edges of said adjacent units, to permit axial removal of the aforesaid unit through the hexagonally defined opening between the hexagonal faces of said adjacent units.

11. A cooling and guiding unit as defined in claim 10 for apparatus wherein the base structure has a plurality of coolant-delivering passages: in which the supporting means comprises a hollow stem formed with the first-mentioned means and axially movably disposed in one of said passages, said resilient means being coaxial with the stem and abutted by the base structure, and said retaining elements being respectively carried by the stem and the base structure.

12. A cooling and guiding unit as defined in claim 10, in which the supporting means comprises a hollow, coolant-delivering stem fixedly carried with the base structure, and said first-mentioned means is a head unit rotatably and removably mounted on said stem, said resilient means being coaxial with the stem and abutting the head unit, and said retaining elements being respectively carried by the head unit and the stem.

13. A cooling and guiding unit as defined in claim 10, in which alternate peripheral edges of the hexagonal face of the first-mentioned means each carry a projection shaped to space such edge from the adjacent edge of the hexagonal face of another unit, each such projection being disposed along the edge at one side of the center of the edge, so that when the first-mentioned means is depressed and turned for removal, said projection will clear a like projection on a ten-adjacent edge of another hexagonal face.

14. A cooling and guiding unit as defined in claim 10, further comprising mutually engageable structures respectively carried by the first-mentioned means and by the base structure, for holding the first-mentioned means against rotation from a predetermined angular position, said structure being disengaged when the first-mentioned means is depressed and is turned for removal.

15. A cooling and guiding unit as defined in claim 10 in which the aforesaid engaged and disengaged positions of the unit differ by an angle which is divisible by 60°.

16. A cooling and guiding unit as defined in claim 1 in which the aforesaid engaged and disengaged positions of the unit differ by an angle which is divisible by 60°.

* * * * *